US009725222B2

(12) United States Patent
Rossmann

(10) Patent No.: US 9,725,222 B2
(45) Date of Patent: Aug. 8, 2017

(54) DEVICE FOR AT LEAST ONE OF STORING AND TRANSPORTING A PLURALITY OF PACKAGING CONTAINERS

(71) Applicant: Nipro Sterile Glass Germany AG, Muennerstadt (DE)

(72) Inventor: Udo Rossmann, Bad Bocklet (DE)

(73) Assignee: Nipro Sterile Glass Germany AG, Muennerstadt (DE)

( * ) Notice: Subject to any disclaimer, the term of this patent is extended or adjusted under 35 U.S.C. 154(b) by 0 days.

(21) Appl. No.: 14/560,545

(22) Filed: Dec. 4, 2014

(65) Prior Publication Data

US 2015/0114853 A1 Apr. 30, 2015

Related U.S. Application Data

(63) Continuation of application No. PCT/EP2013/063140, filed on Jun. 24, 2013.

(30) Foreign Application Priority Data

Jun. 27, 2012 (DE) ..... 10 2012 105 641

(51) Int. Cl.
*B65D 71/06* (2006.01)
*B01L 9/06* (2006.01)
(Continued)

(52) U.S. Cl.
CPC ..... *B65D 71/06* (2013.01); *B01L 9/06* (2013.01); *B01L 9/543* (2013.01);
(Continued)

(58) Field of Classification Search
CPC .. B65D 71/06; B65D 25/005; B65D 11/1886; B65D 11/188; B65D 2543/00027; B65D 2543/00194
See application file for complete search history.

(56) References Cited

U.S. PATENT DOCUMENTS 435,022 A * 8/1890 Robinson ..... B65D 5/4208 206/45.28
1,445,816 A * 2/1923 Bailey ..... B65D 7/32 220/315
(Continued)

FOREIGN PATENT DOCUMENTS

DE 91 12 325 1/1992
DE 690 04 889 4/1994
(Continued)

*Primary Examiner* — Anthony Stashick
*Assistant Examiner* — James Way
(74) *Attorney, Agent, or Firm* — Lipsitz & McAllister, LLC

(57) ABSTRACT

The invention relates to a device for at least one of storing and transporting a plurality of packaging containers comprises a tub-shaped lower part and an upper part for closing the lower part in a closed position in which they enclose an interior of the device. The lower part has a bottom and a lower-part wall projecting from the bottom in the direction of the upper part. The lower part comprises a wall element which with the lower-part wall forms a circumferential wall of the lower part. The wall element is movable relative to the lower part in order to at least partially open the wall.

20 Claims, 9 Drawing Sheets

(51) Int. Cl.

| | |
|---|---|
| ***B65D 21/02*** | (2006.01) |
| ***B65D 25/00*** | (2006.01) |
| ***B65D 43/02*** | (2006.01) |
| ***B65D 51/26*** | (2006.01) |
| ***B01L 9/00*** | (2006.01) |

(52) U.S. Cl.
CPC ..... *B65D 21/0233* (2013.01); *B65D 25/005* (2013.01); *B65D 43/0212* (2013.01); *B65D 51/26* (2013.01); *B01L 2200/18* (2013.01); *B65D 2543/00027* (2013.01); *B65D 2543/00194* (2013.01); *B65D 2543/00296* (2013.01); *B65D 2543/00509* (2013.01); *B65D 2543/00555* (2013.01); *B65D 2543/00648* (2013.01); *B65D 2543/00685* (2013.01); *B65D 2543/00944* (2013.01)

(56) References Cited

U.S. PATENT DOCUMENTS 1,840,561 A 1/1932 Bre Miller
1,950,118 A 3/1934 Lifton
2,990,948 A * 7/1961 Zackheim ..... B65D 77/2032 206/439
3,272,378 A * 9/1966 Weber ..... B65D 1/243 220/510
3,643,812 A * 2/1972 Mander ..... B01L 9/06 206/443
3,675,808 A * 7/1972 Brink ..... B65D 1/225 206/509
3,744,665 A * 7/1973 Spoto ..... B01L 9/06 211/76
3,762,594 A * 10/1973 Utz ..... B65D 1/243 206/427
3,924,798 A * 12/1975 Saveth ..... B65D 5/324 220/62
3,993,211 A 11/1976 Astle
3,997,055 A * 12/1976 Box ..... B65D 1/22 206/427
4,002,287 A * 1/1977 Saveth ..... B65D 11/1886 220/62
4,625,908 A * 12/1986 Emery ..... B65D 5/503 206/427
4,911,300 A * 3/1990 Colonna ..... B65D 71/50 206/427
5,074,738 A 12/1991 Ehara et al.
5,351,814 A * 10/1994 Apps ..... B65D 1/243 206/139
5,803,295 A * 9/1998 Tussey ..... B65D 11/10 220/1.5
5,897,011 A * 4/1999 Brilliant ..... B65D 43/162 220/266
6,003,706 A 12/1999 Rosen
7,832,584 B2 * 11/2010 Eggers ..... B25H 3/023 206/373
8,434,620 B2 * 5/2013 Hall ..... B65D 5/48038 206/433
9,095,848 B2 * 8/2015 Carrel ..... A61M 5/002
2003/0189048 A1 * 10/2003 Luburic ..... B65D 43/0256 220/276
2005/0184070 A1 * 8/2005 Boback ..... B65D 43/021 220/266
2012/0048762 A1 3/2012 Whitehead
2013/0001223 A1 * 1/2013 Cavalcante ..... B65D 11/1833 220/4.01
2013/0320006 A1 * 12/2013 Orgeldinger ..... B65D 1/243 220/4.33

FOREIGN PATENT DOCUMENTS

| | | |
|---|---|---|
| DE | 199 51 172 | 4/2001 |
| DE | 202 18 763 | 3/2003 |
| EP | 0 356 543 | 3/1990 |
| EP | 1 128 907 | 3/2003 |
| EP | 2 422 880 | 2/2012 |
| FR | 1 234 195 | 10/1960 |
| GB | 2 258 206 | 2/1993 |
| WO | WO 2011/154125 | 12/2011 |

* cited by examiner

DEVICE FOR AT LEAST ONE OF STORING AND TRANSPORTING A PLURALITY OF PACKAGING CONTAINERS

CROSS-REFERENCE TO RELATED APPLICATIONS

This application is a continuation of international application No. PCT/EP2013/063140 filed on Jun. 24, 2013 and claims the benefit of German application number 10 2012 105 641.2 filed on Jun. 27, 2012, which are incorporated herein by reference in their entirety and for all purposes.

FIELD OF THE INVENTION

The present invention relates to devices for at least one of storing and transporting a plurality of packaging containers generally, and more specifically to a device for at least one of storing and transporting a plurality of packaging containers, comprising a tub-shaped lower part and an upper part for closing the lower part in a closed position in which the lower part and the upper part enclose an interior of the device, the lower part comprising a bottom and a lower-part wall projecting from the bottom in the direction of the upper part.

BACKGROUND OF THE INVENTION

Such a device, which may also be referred to as package or outer package, is known, for example, from DE 91 12 325 U1. Herein the lower part is formed by a dish-shaped or trough-shaped receiving container which is open at the top, and the upper part is formed by a plastic sheet. The, in particular, small packaging containers may, in particular, be primary packaging articles such as, for example, storage glasses, pipettes, small bottles, cartridges, ampoules, cans, syringes and vials and the like for pharmaceutical and/or chemical applications. In particular, primary packaging articles which have a certain stability are also used.

The manufacturer of the primary packaging articles usually delivers these in a device of the kind described at the outset to a secondary producer, for example, a manufacturer of pharmaceuticals. It is important that the primary packaging articles contained in the device should get to the secondary producer in a sterile state and, more specifically, to his workshop, which is also sterile. The primary packaging articles are ready-to-sterilize (RTS) or ready-to-use (RTU) if the device with packaging containers was already sterilized before delivery to the manufacturer of pharmaceuticals.

If, for example, small glass containers are transported in the device, these must be removed from the device before the filling, for example, with a medicine, and transferred to a filling installation provided for the filling. However, the removal of a plurality of small packaging containers from a tub-shaped lower part is problematic, in particular, when these are not positioned in a defined manner in the lower part.

SUMMARY OF THE INVENTION

In a first aspect of the invention, a device for at least one of storing and transporting a plurality of packaging containers comprises a tub-shaped lower part and an upper part for closing the lower part in a closed position in which they enclose an interior of the device. The lower part has a bottom and a lower-part wall projecting from the bottom in the direction of the upper part. The lower part comprises a wall element which with the lower-part wall forms a circumferential wall of the lower part. The wall element is movable relative to the lower part in order to at least partially open the wall.

BRIEF DESCRIPTION OF THE DRAWINGS

The foregoing summary and the following description may be better understood in conjunction with the drawing figures, of which.

DETAILED DESCRIPTION OF THE INVENTION

Figure 1:
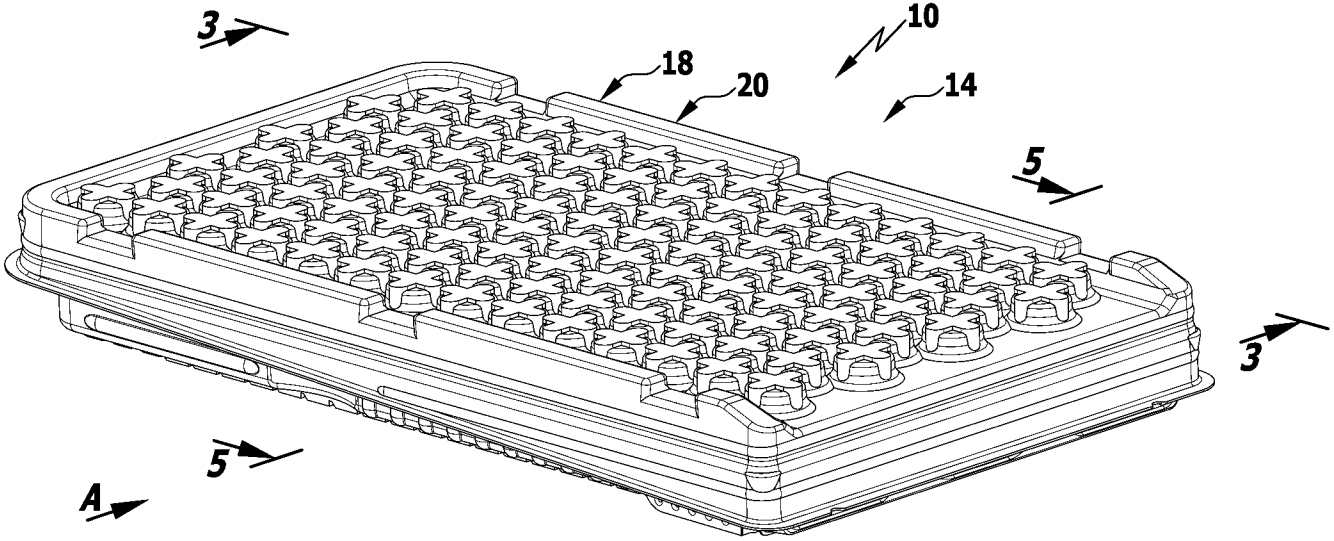
FIG. 1 shows a perspective schematic overall view of a device in accordance with the invention for storing and/or transporting a plurality of packaging containers.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a device for at least one of storing and transporting a plurality of packaging containers, comprising a tub-shaped lower part and an upper part for closing the lower part in a closed position in which they enclose an interior of the device, the lower part having a bottom and a lower-part wall projecting from the bottom in the direction of the upper part, wherein the lower part comprises a wall element which with the lower-part wall forms a circumferential wall of the lower part, and wherein the wall element is movable relative to the lower part in order to at least partially open the wall.

The further development proposed in accordance with the invention makes it possible, in particular, to open the tub-shaped lower part partially at the side by moving part of the wall, namely the separable wall element, relative to the lower part. Such a movement may, in particular, be a translatory and/or a rotatory movement, i.e., for example, a sliding and/or a pivoting movement. In particular, a lateral opening of the lower part can therefore take the form of a gap in the wall, for example. Depending on the configuration of the lower part, it is therefore, in particular, possible to lift out the packaging containers located in the device not only after complete removal of the upper part from the lower part, which requires corresponding gripper devices, but to push these sideways out of the tub-shaped lower part through the gap created as a result of movement of the wall element. This has the advantage that a filling installation or packing machine in which the packaging containers are filled with medicine, for example, can be easily loaded with the packaging containers without these having to be individually grasped or gripped in order to lift them out of the lower part. This is also advantageous because the packaging containers do not have to be positioned in a defined manner in the lower part. To remove the packaging containers from the device, for example, the wall element is first moved relative to the lower part, for example, pivoted about a pivot axis, and the packaging containers are then pushed out of the lower part and into the filling installation.

It is expedient for the wall element to be separable from the lower part. In particular, the wall element can be reversibly or irreversibly separable from the lower part. It is, for example, conceivable to form the wall element and the lower part in one piece and to provide a predetermined breaking point, which makes the one-time irreversible separating of the wall element from the lower part possible. Alternatively, the wall element may also be constructed so as to be releasably connectable to the lower part by a connecting device in order to reversibly separate the wall element from the lower part and, when required, connect it to it again. In particular, the wall element and the lower part can therefore be manufactured separately from each other and only brought into engagement with each other for formation of the device. The complete release of the wall element has, in particular, also the advantage that it can be removed completely and, for example, does not interfere when the packaging containers are transferred, in particular, by being pushed out, from the device into a filling installation.

It is advantageous for the lower-part wall and the bottom to be of one-piece construction. They therefore form a unit, thereby increasing the stability of the device in its entirety.

It is expedient for the bottom to be of rectangular or substantially rectangular construction, and for the lower-part wall to comprise at least three complete wall sections which project from side edges of the bottom. All in all, a parallelepipedal or substantially parallelepipedal device can thereby be formed, which can be transported and stored with a minimal space requirement together with other similar devices in larger packaging units, which are preferably also of parallelepipedal shape.

To prevent packaging containers from falling out of the device in the closed position, the wall element closes a gap formed in the lower-part wall preferably completely. In this way, a delimitation of the interior on all sides can be achieved in the closed position by the lower part and the upper part. Furthermore, the interior is also protected against penetration of dirt and the like.

The wall element expediently forms an end wall of the lower part. Even after separation of the wall element, a sufficient stability can therefore be ensured for transferring the packaging containers safely from the device to a filling installation, for example.

In accordance with a further preferred embodiment of the invention, it may be provided that the device comprises a connection device for releasably connecting the wall element to the bottom and the lower-part wall. It is therefore, in particular, possible to manufacture the wall element independently of the bottom and the lower-part wall and to subsequently connect it to the bottom and the lower-part wall in order to form the tub-shaped lower part.

The connection device can be formed in a particularly simple way if it comprises first and second interacting connection elements which are arranged or formed, on the one hand, on the bottom and/or on the lower-part wall and, on the other hand, on the wall element, and if the first and second connection elements engage one another with force and/or positive locking in a storage position in which the wall element forms part of the circumferential wall.

The parts of the device to be connected to one another can be easily and securely connected to one another if the connection device takes the form of a locking connection device, and if the first and second connection elements take the form of locking connection elements which are engageable with one another. The wall element and the bottom and the lower-part wall, respectively, can therefore be connected to one another by simple locking and also released from one another again.

A connection device can be formed in a particularly simple and secure way if the first and second connection elements take the form of connection projections and connection recesses for at least partially receiving the connection projections. The connection projections and connection recesses may be selectively arranged or formed on the wall element or on the bottom and on the lower-part wall, respectively. It is, in particular, also conceivable to provide on each of the aforementioned elements of the device both at least one connection projection and at least one connection recess.

To enable as secure a connection as possible of the parts of the device connected to one another in the storage position, it is expedient for the first and second connection elements to be engageable with one another in a direction of connection which is oriented transversely to a bottom surface defined by the bottom. The direction of connection preferably forms a surface normal of the bottom surface, i.e., extends perpendicularly thereto. Therefore, relatively large forces must be applied in order to release the wall element in a direction parallel to the floor surface, i.e., in particular, perpendicularly to the direction of connection, from the bottom and the lower-part wall. Unintentional separation of the wall element from the bottom and from the lower-part wall can thereby be avoided.

To enable the packaging containers to be removed, in particular, pushed in a simple way out of the interior, it is expedient for the bottom to define a flat bottom surface delimiting the interior. For example, as a consequence of a corresponding inclination of the lower part, it is therefore also possible for the storage containers to slide out of the lower part following separation of the wall element, should this be desired.

The bottom advantageously comprises a plurality of depressions which are open in the direction facing the interior. The depressions can, on the one hand, in particular, contribute towards stiffening the bottom and hence the lower part, and, on the other hand, they also make it possible for a certain moisture in the form of condensate after sterilization of the device to be collected and kept away from the packaging containers stored in the device.

It is expedient for the plurality of depressions to be formed between webs extending transversely to one another and defining the bottom surface. A spacing between the webs depends essentially, in particular, on the size of the packaging containers which are to be stored and transported, respectively, in the device. It is preferably ensured that the packaging containers rest with their base area always on at least two adjacent webs, better on three or more webs.

It is particularly advantageous for the bottom surface to extend as far as the gap formed by the lower part. The packaging containers can therefore be pushed directly through the gap, for example, into a filling installation.

In order to further increase the stability of the lower part, it is expedient for the lower-part wall to have an upper lower-part edge which faces in the direction of the upper part and is set back in sections thereof. Set back may, in particular, mean that recesses facing in the direction of the bottom are formed on the lower-part edge. Viewed in the reverse direction, projections are therefore formed which, for example, are engageable with corresponding recesses on the upper part so as to enable a defined closing of the device in the closed position.

In order that the stability of the lower part can be further increased, it is advantageous for the lower-part wall and/or the bottom to comprise a plurality of beads. These may be formed so as to be oriented perpendicularly and/or parallel to the bottom surface.

In order to further improve the handling of the device, in particular, when loading a filling installation with packaging containers located in the device, it is expedient for at least one holding recess to be formed, in each case, on two opposite wall sections on the lower-part wall. With a corresponding projection on a receiving part of a filling installation, it is, for example, therefore possible for the device to be temporarily coupled to the filling installation in order, in particular, after separation of the wall element, to manipulate the lower part in such a way that the packaging containers can be transferred in a defined and desired manner to the filling installation, for example, by sliding into it. Two or more holding recesses are preferably formed on each wall section. A connection, in particular, with a filling installation can thereby be improved and established in a specially defined manner.

The lower part can be gripped and held particularly easily and securely if each holding recess in the lower-part wall is open facing away from the interior. In the case of a correspondingly thin wall thickness of the material forming the lower-part wall, a projection extending somewhat into the interior can also be optionally formed.

The lower part can be easily and securely held if each holding recess has a delimiting surface which takes the form of a cylinder wall section.

The cylinder wall section expediently defines a cylinder axis which is oriented transversely to the bottom surface. It is expedient for it to be oriented perpendicularly to the bottom surface.

To enable the holding recesses to be easily and securely gripped, it is expedient for a radius of curvature defined by the holding recesses to be at least three times larger than a width of one of the beads.

Each holding recess expediently has a height which corresponds approximately to half the height of the lower-part wall. It is therefore possible to maintain the stability of the lower part and, in particular, at the same time, to allow a secure temporary coupling of the lower part to a filling installation.

In accordance with a further preferred embodiment of the invention, it may be provided that the device comprises a wall element separating device for automatically separating the wall element from bottom and lower-part wall. With the wall element separating device, it is, therefore, in particular, possible to easily separate the wall element automatically, i.e., for example, when bringing the device into engagement with a filling installation, in order to thereby also transfer the packaging containers automatically from the interior into the filling installation.

The wall element separating device can be formed in a particularly simple way if it comprises at least one separating element which is adapted to be brought from the storage position in which the wall element forms part of the circumferential wall into a separated position. Two separating elements are preferably provided, which are arranged or formed symmetrically on the wall element. In particular, these separating elements may be of such construction that the separating elements can be easily and securely gripped with corresponding gripper devices of a filling installation in order to automatically separate the wall element from the bottom and the lower-part wall.

The at least one separating element can be manufactured particularly easily if it takes the form of a flat lobe-shaped projection.

The at least one separating element is preferably arranged or formed so as to be movable on the wall element. Movable may, in particular, mean slidable or pivotable.

It is particularly advantageous for the at least one separating element to be pivotable about a pivot axis extending transversely to the bottom surface relative to the wall element. It can therefore be easily moved into different pivoted positions.

The wall element can be manufactured particularly easily if the at least one separating element, in the separated position, projects laterally from the wall element as an extension thereof. In particular, the basic position of the wall element can, at the same time, define the separated position. In other words, the wall element can be manufactured in one piece with separating elements projecting laterally.

It is expedient for the at least one separating element, in the closed position, to extend parallel or substantially parallel to a wall section of the lower-part wall adjoining the gap and/or to lie against the wall section. In particular, in the closed position, it can be pivoted through 90° in relation to the separated position. This ensures, in particular, that in the closed position it does not project in an undefined manner from the device and unintentional separating of the wall element cannot occur inadvertently.

The upper part preferably has a circumferential upper-part wall which faces the lower part and, in the closed position, engages over the wall on all sides. This configuration ensures that the interior can be closed in a defined manner and also kept closed.

It is expedient for the upper-part wall to have two upper-part wall sections which are located opposite each other and are of different height, and for a height of the upper-part wall section arranged, in the closed position, in the area of the wall element to be greater than a height of the opposite upper-part wall section. This configuration offers the advantage that the upper part can be partly raised, in particular, in such a way that the wall element is substantially released, and yet the upper part can still engage completely over the lower part. In this way, the contents of the device, i.e., in particular, the packaging containers stored therein are still well protected even if the wall element should already be separated.

The upper-part wall preferably engages at least partially over the at least one separating element in the closed position, so that the at least one separating element is arranged between the lower-part wall and the upper-part wall in the closed position. In this way, the separating element is, on the one hand, protected in the closed position, and, on the other hand, it can therefore also be held by the upper part in the closed position. In other words, it cannot transfer automatically to the separated position.

It is advantageous for a height of the upper-part wall to increase in the direction of the upper-part wall section associated with the wall element on those sides of the upper part on which the upper-part wall engages over wall sections of the lower-part wall adjoining the wall element. For example, with a rectangular bottom, it may then be provided that the upper-part wall sections of the upper part, which form longitudinal sides of the upper part, have a height which increases in the direction of the wall element. This makes it possible to raise the upper part, for example, in the area of the wall element and to ensure that with the upper-part wall it nevertheless still engages on all sides over the lower-part wall.

To make the wall element easily accessible and nevertheless ensure that the interior of the device is completely covered by the upper part, it is expedient for a height of the upper-part wall section associated with the wall element in the closed position to be at least 50% larger than a height of the opposite upper-part wall section.

In accordance with a further preferred embodiment of the invention, it may be provided that the at least one separating element is constructed such that the upper-part wall can slide on the separating element during the transition from the storage position to the separated position, and that the upper part is thereby pivotable about a pivot axis extending in the area of the wall section located opposite the wall element. This allows the upper part in the area of the wall section of the lower part located opposite the wall element to be left, as it were, in the closed position, but the upper part to be raised in the area of the wall element to such an extent that the wall element can be easily separated from the bottom and the lower-part wall in order to transfer the packaging containers from the device into a filling installation, for example. The pivot axis can be defined by connection or coupling elements of upper part and lower part, which engage one another and extend in a direction parallel to the bottom of the device.

The upper part in the area of the wall element can be easily raised owing to the upper-part wall resting in the separated position on the at least one separating element and engaging over the lower-part wall on all sides. In particular, during the transition of the least one separating element from the closed position to the separated position, the upper-part wall can therefore slide on the separating element and raise the upper part in the area of the wall element until it rests in the separated position on the least one separating element when this, as it were, assumes the basic position again, i.e., projects laterally from the wall element as an extension thereof.

The device preferably comprises a coupling device for releasably connecting the upper part and the lower part to each other. At least a temporary connection can therefore be established in a defined manner between the upper part and the lower part in order to protect the packaging containers located in the interior.

The coupling device can be formed in a particularly simple way if it comprises first and second interacting coupling elements which are arranged or formed, on the one hand, on the wall element and/or on the lower-part wall and, on the other hand, on the upper part, and if the first and second coupling elements engage each other with force and/or positive locking in the closed position. In particular, the coupling elements can be formed or arranged in the area of the upper-part wall and the lower-part wall. For example, coupling elements can also be formed in the area of the lower-part edge of the lower part facing in the direction of the upper part.

It is advantageous for the coupling device to take the form of a locking connection device and for the first and second coupling elements to take the form of locking connection elements engageable with each other. This configuration makes it possible, for example, for the engaging and disengaging of the locking connection elements to be audible for a user so that he immediately recognizes whether the upper part has already assumed the closed position relative to the lower part or has been moved out of it.

It is expedient for the first and second coupling elements to take the form of coupling projections and coupling recesses for at least partially receiving the coupling projections. Such coupling elements can be formed particularly easily. In addition, they can also serve, at the same time, as stabilizing elements in the device. In particular, they can take the form of beads or the like so as to enable as thin-walled a material as possible to be used for manufacturing the upper part and the lower part. On the one hand, this saves manufacturing costs and, on the other hand, the weight of the device can thereby be reduced.

The upper part preferably comprises a positioning device for defined positioning of the packaging containers. With the positioning device, the packaging containers can, in particular, be brought into a defined position relative to one another. For example, the packaging containers can thereby be prevented from touching one another so as to avoid damage, in particular, to packaging containers made of glass. Such an advantageous further development may, in particular, also be provided in a device for storing and/or transporting a plurality of packaging containers, comprising a tub-shaped lower part and an upper part for closing the lower part in a closed position in which the lower part and the upper part enclose an interior of the device, the lower part having a bottom and a lower-part wall projecting from the bottom in the direction of the upper part. The positioning device performs its function, in particular, when the upper part closes the lower part. If the upper part is removed from a lower part in which no positioning device is provided, the packaging containers can be moved in a desired manner relative to one another, for example, pushed out of the lower part.

The positioning device can be formed particularly easily if it comprises a plurality of positioning recesses which in the closed position are open in the direction facing the bottom. In particular, the positioning recesses can therefore each receive a part of a packaging container in order to force it into a prescribed position.

It is expedient for the positioning recesses to have a rotationally symmetrical or substantially rotationally symmetrical basic shape. In a simple and defined way, they can therefore prescribe in a desired manner the position of rotationally symmetrical packaging containers in the interior.

It is advantageous for the positioning recesses to comprise sterilization channels. In particular, the sterilization channels make it possible for, in particular, a sterilization gas such as ethylene oxide to flow into the packaging containers even when the device is closed, i.e., for example, when the upper part is fitted.

In order to increase the stability of both the positioning device and the upper part, it is advantageous for the positioning recesses to comprise stiffening elements. These may, for example, take the form of recessed or projecting webs, which make twisting of the upper part difficult.

The device can be of particularly compact construction if the positioning recesses comprise stiffening elements which, in particular, define the sterilization channels.

Furthermore, it may be expedient for the upper part to define with its underside an upper-part plane which in the closed position extends parallel to a bottom plane defined by the bottom. The packaging containers can therefore be held in a defined manner between the upper-part plane and the bottom plane in the device.

The device expediently comprises a plurality of packaging containers. It may already be loaded with corresponding, preferably sterile, packaging containers so as to enable a secondary producer to directly fill the packaging containers with a charge. The device is, in principle, suitable, after loading with the packaging containers, to be sterilized, for example, with a gas such as ethylene oxide (EtO). It is therefore "ready-to-sterilize" (RTS). After sterilization of the device loaded with packaging containers, it is then "ready-to-use" (RTU), i.e., ready for direct filling with a charge by the secondary producer.

In accordance with a further preferred embodiment of the invention, it may be provided that each packaging container defines a packaging-container longitudinal axis, that each positioning recess defines a positioning-recess longitudinal axis, and that in the closed position a packaging-container longitudinal axis, in each case, and a positioning-recess longitudinal axis, in each case, coincide or coincide substantially. This configuration makes it possible, in particular, to position the packaging containers in a simple and defined way in the interior of the device.

The packaging containers preferably have a rotationally symmetrical shape. They can therefore be easily manufactured and positioned in a defined manner independently of a rotation position in the device.

It is expedient for a spacing between the upper-part plane and the bottom surface in the closed position to be smaller than a height of the packaging containers, and for a packaging container, in each case, to project at least partially into a positioning recess. In this way, the packaging containers are positioned in a simple and clearly defined manner owing to the partial entry into the positioning recess of the upper part in the interior.

It is advantageous for the packaging containers to take the form of primary packaging articles, for example, storage glasses, pipettes, ampoules or the like. They can then, in particular, if they were stored in sterile condition in the device, be used directly by a secondary producer to fill them in a filling installation.

It is expedient for the device to have a plane of symmetry which extends perpendicularly to the bottom and divides the wall element into two halves which are mirror-symmetrical in relation to each other. This simplifies, on the one hand, the construction of the device and, on the other, also its handling.

The stability of the device can be increased, in particular, by it being in its entirety of three-part construction. In other words, it comprises only three parts, namely the upper part, the wall element optionally with separating device, and the unit formed of bottom and lower-part wall.

The device can be manufactured particularly cost-effectively from a plastic material, in particular, a thermoplastic material. The shape desired for the device is preferably imparted to it by thermoforming. In particular, deep-drawing is suitable for use of, for example, plastic materials such as polycarbonate, polyethylene, polyvinyl chloride, polypropylene or polystyrene for manufacturing the device. The plastic material for manufacturing the device is preferably a sterilizable plastic material. The device can be sterilized by, for example, superheated steam, gases such as, for example, ethylene oxide or use of ionizing radiation, i.e., in particular, gamma radiation or beta radiation.

FIG. 1 shows schematically a device 10 for storing and/or transporting a plurality of, in particular, small packaging containers 12, which will also be referred to hereinbelow as package 14. It comprises a tub-shaped lower part 16 and an upper part 18 in the form of a lid 20 for closing the lower part 16 in a closed position as shown, by way of example, in the Figures. In the closed position, the lower part and the upper part enclose and define, respectively, an interior 22 of the package 14.

The lower part 16 comprises a bottom 24, which is of substantially rectangular construction, with a bottom surface 26, which defines a bottom plane 28. Three wall sections 30, 32 and 34 extend from the bottom in the direction of the upper part 18. Together they form a substantially U-shaped lower-part wall 36, which is formed in one piece with the bottom 24 and therefore forms a unit 38 with it. The unit 38 is formed mirror-symmetrically in relation to a plane of symmetry 40. The wall sections 30 and 32 are formed mirror-symmetrically in relation to the plane of symmetry 40 and extend along the longer side of the bottom 24.

The wall section 34 forms an end wall 42 of the unit 38. Formed opposite it is a gap 44, which extends as far as the bottom plane 28 and between the side wall sections 30 and 32. To close this gap 44, the lower part 16 further comprises a wall element 46, which is separable from the unit 38. It may, for example, be initially formed in one piece with the unit 38 and be separated once from the unit 38 by predetermined breaking points provided in a corresponding manner.

In the embodiment, shown in the Figures, of the device 10 in accordance with the invention, provision is, however, made for releasably connecting the wall element 46 to the unit 38. The wall element 46 therefore forms an end wall 48 opposite the wall section 34 when the lower part 16 assumes the storage position in which the wall element 46 is connected to the unit 38 and forms part of a circumferential wall 50 of the lower part 16, the wall 50 comprising the wall sections 30, 32 and 34 and the wall element 46. The wall element 46 closes the gap 44 in the storage position completely.

For releasable connection of the wall element 46 to the unit 38, a connection device 52 is provided, which comprises first connection elements 54, 54*a* and second connection elements 56, 56*a*, which are arranged or formed, on the one hand, on the bottom 24 and on the lower-part wall 36 and, on the other hand, on the wall element 46. In the storage position, the first and second connection elements 54, 54*a* and 56, 56*a* are in engagement with one another with force and/or positive locking. The connection device 52 preferably takes the form of a locking connection device 58, with the first and second connection elements 54, 54*a*, 56 and 56*a* taking the form of locking connection elements which interact.

In the embodiment of the device 10 shown in the Figures, the first connection elements 54 and 54*a* take the form of connection projections 60 and 60*a*, the second connection elements 56 and 56*a* the form of connection recesses 62 and 62*a*, which are formed for at least partially receiving the connection projections 60 and 60*a*.

The connection projections 60 are formed inside a wall section receptacle 64 of the wall element 46 and, in the storage position, face in the direction of the bottom 24. The wall section receptacles 64 are formed for receiving free ends 66 of the wall sections 30 and 32, which laterally delimit the gap 44. The connection recesses 62 for receiving the connection projections 60 are formed on a lower-part edge 68 of the lower-part wall 36, which faces in the direction of the upper part 18, and are open facing away from the bottom 24 for receiving the connection projections 60.

The connection projections 60*a* are formed in the bottom 24 by deep-drawing and face away from the underside 70 of the bottom 24, i.e., are open in the direction facing the upper part 18. A total of three connection projections 60 are provided, which are formed immediately adjacent to the gap 44 in the bottom 24 and extend transversely to the plane of symmetry 40. The connection recesses 62*a* are formed in a bottom receptacle 72 of the wall element 46, into which the bottom 24 enters when the lower part 16 assumes the storage position.

The first and second connection elements 54, 54*a* and 56, 56*a* are formed such that they are engageable and disengageable in a direction of connection 74, which extends transversely to the bottom plane 28. It can thereby be ensured that the wall element 46 cannot be unintentionally separated from the unit 38 without the action of external forces.

A plurality of depressions 76 are formed in the bottom 24 and are open in the direction facing the interior 22. The plurality of depressions 76 are formed between webs 78 and 80 extending transversely to one another. The webs 80 extend parallel to the plane of symmetry 40, the webs 78 perpendicularly thereto. The bottom surface 26 is formed by the webs 80 extending in the longitudinal direction of the package 14. Owing to the special arrangement of the recesses 76 and the webs 78 and 80, a plurality of sterilization channels 81 extending parallel to one another and also to the wall sections 30 and 32 in the longitudinal direction are formed, which improve the inflow and uniform distribution, in particular, of a sterilization gas such as ethylene oxide when the package 14 is closed and loaded with packaging containers 12. They also stabilize the bottom 24.

It should also be mentioned that the upper lower-part edge 68 at the wall sections 30 and 32 is set back somewhat on three short sections 82. Furthermore, the lower-part wall 36 comprises a plurality of beads 84 extending in a direction perpendicular to the bottom plane 28, which serve to stiffen the lower part 16. Also, adjacent to the wall section 34 and the bottom 24, two beads 86 extending parallel to the bottom surface 26 are formed in the two wall sections 30 and 32. The bottom 24 also comprises a plurality of beads 88 and 90, which are delimited by the webs 78 and 80 and, in each case, extend parallel to these.

Furthermore, each of the two wall sections 30 and 32 comprises two holding recesses 92, which are open in the lower-part wall 36 facing away from the interior 22. A delimiting surface 94 of each holding recess 92 takes the form of a cylinder wall section 96, which defines a cylinder axis, which is oriented perpendicularly to the bottom plane 28. A radius of curvature of the cylinder wall sections 96 is more than three times larger than the width of the beads 84, 86, 88, 90. A height 98 of the holding recesses 92 corresponds approximately to half of a height 100 of the lower-part wall 36.

A wall element separating device 102 serves for simple separation of the wall element 46 from the unit 38. It comprises at least one, in the embodiment of the device 10 shown in the Figures two separating elements 104, which take the form of flat lobe-shaped projections 106. These are provided with a plurality of knobs 108 on their side facing in the direction of the interior 22. A width of the projections 106 corresponds approximately to the height 98. Furthermore, the projections 106 are approximately twice as long as wide.

Figure 4:
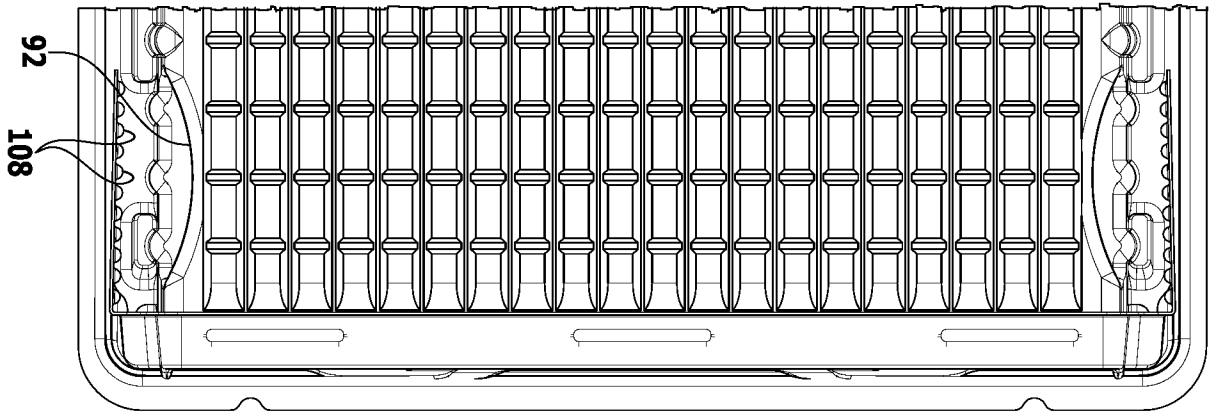
FIG. 4 shows a partial view of the device from FIG. 1 from below in the direction of arrow B in FIG. 2.
Figure 8:
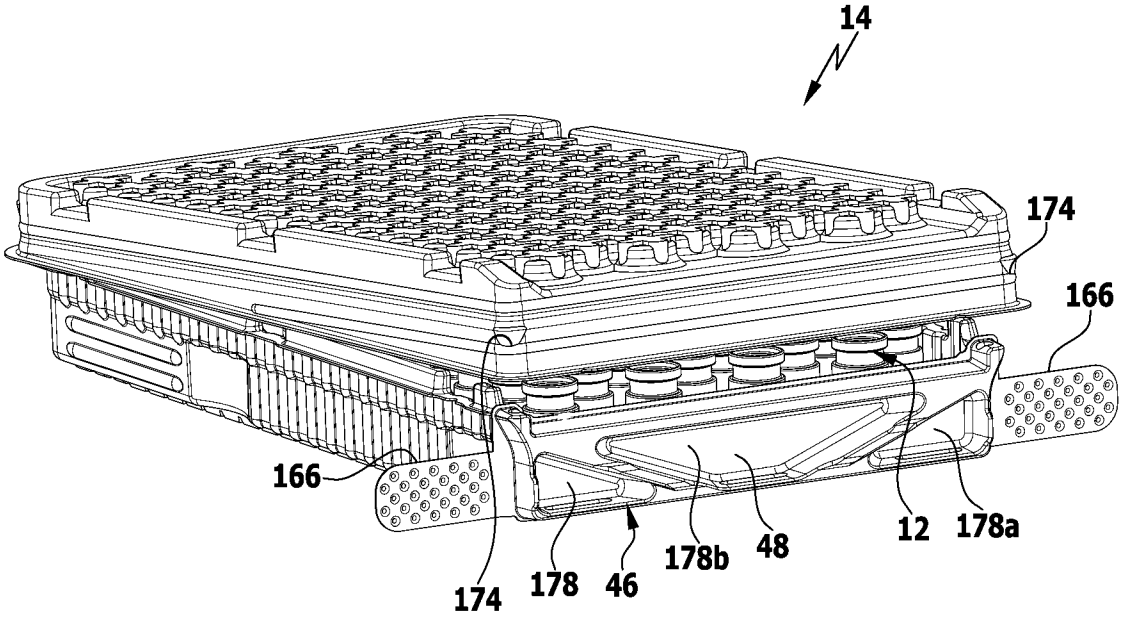
FIG. 8 shows a view similar to FIG. 7 with the upper part raised even further.
Figure 9:
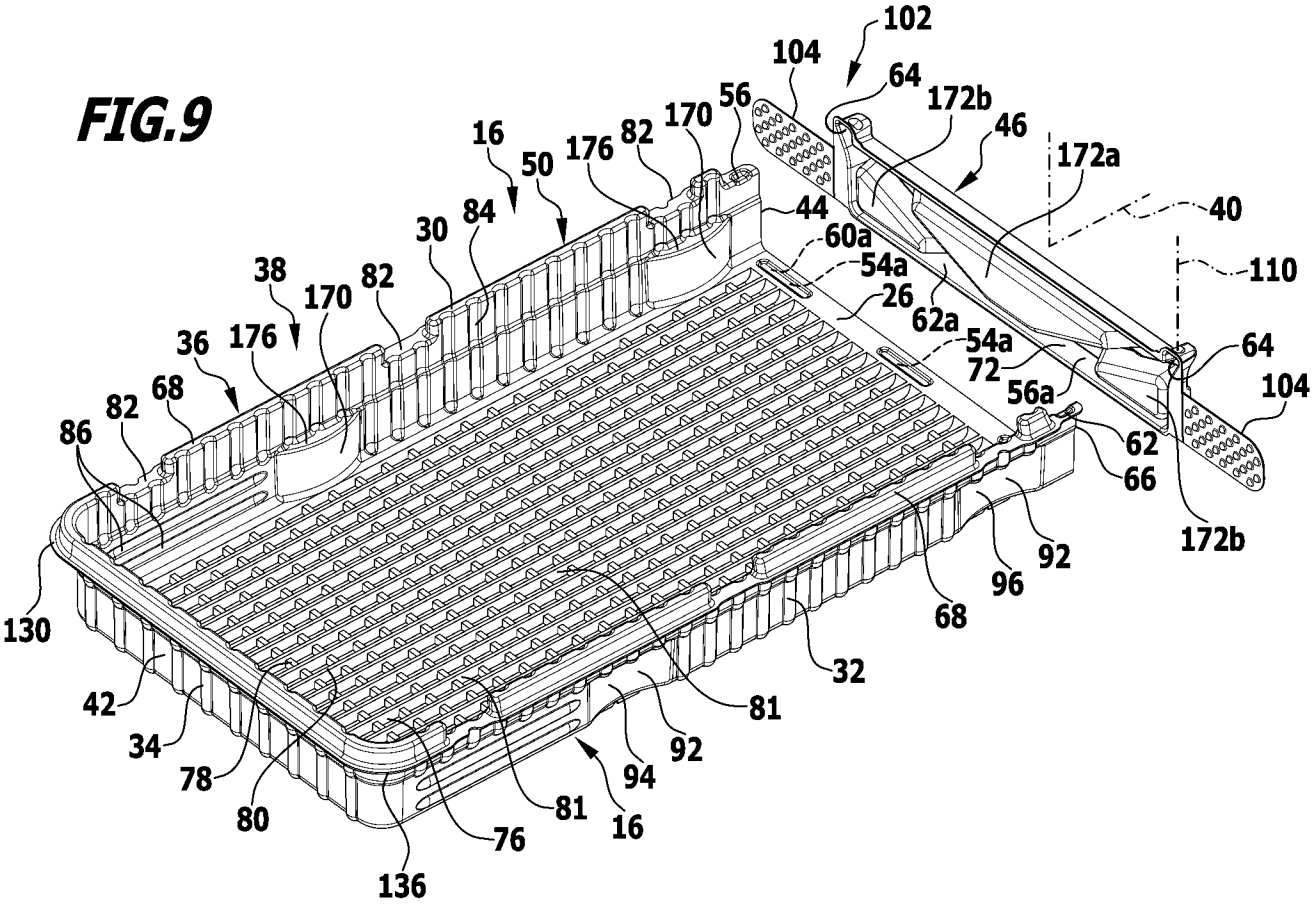
FIG. 9 shows a perspective exploded representation of the lower part.

The separating elements 104 are formed in one piece with the wall element 46 and are movable relative thereto, namely pivotable about a pivot axis 110 which, in the storage position, extends perpendicularly to the bottom plane 28. In the separated position, as shown schematically in FIGS. 7 to 9, the separating elements 104 project laterally from the wall element 46 as an extension thereof. In the closed position, they are pivoted in relation to the separated position through about 90° about the pivot axis 110 and extend parallel or substantially parallel, as shown schematically in FIG. 4, to the wall sections 30 and 32, respectively, adjoining the gap 44. As can be seen clearly in FIGS. 2 and 4, the separating elements 104, in the closed position, cover the holding recesses 92 adjacent to the gap 44.

The upper part 18 comprises a substantially rectangular cover plate 112 and a circumferential upper-part wall 114 extending away from the cover plate 112 in the direction of the lower part 16. As shown schematically in FIG. 1, the upper-part wall 114, in the closed position, engages over the wall 50 on all sides. The upper-part wall 114 further comprises two upper-part wall sections 116 and 118, which are located opposite each other and differ in height. A height of the upper-part wall section 116, which, in the closed position, is arranged in the area of the wall element 64, has a height 120 which is greater than a height 122 of the opposite upper-part wall section 118. In the embodiment shown in the Figures, the height 120 is about twice as large as the height 122. As can be clearly seen in FIG. 2, the upper-part wall 114 engages over the separating elements 104, in the closed position, partially, more specifically almost completely, so that the separating elements 104, in the closed position, are arranged between the lower-part wall 36 and the upper-part wall 114 and are held by the upper-part wall 114 in the pivoted closed position.

Figure 2:
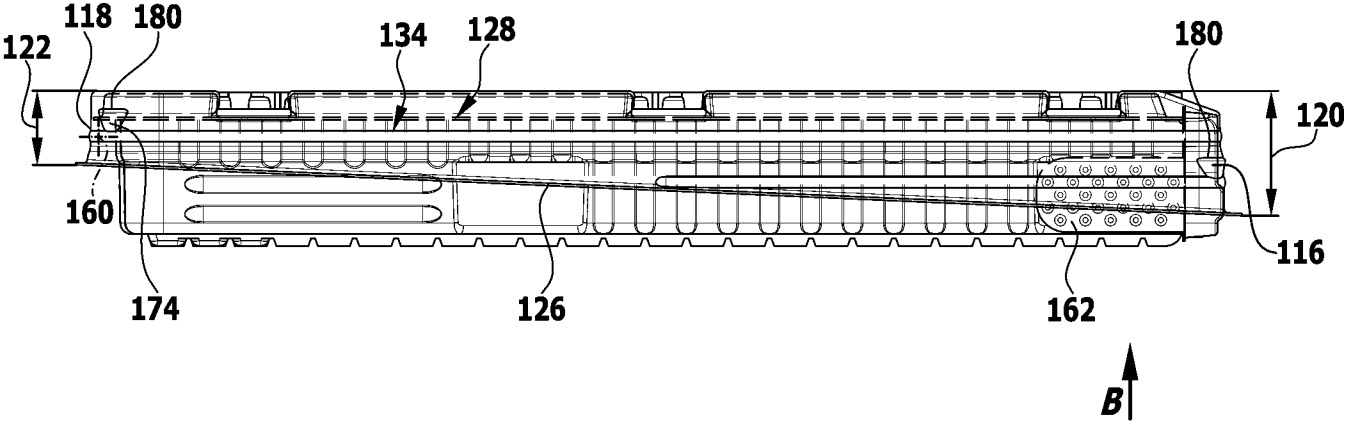
FIG. 2 shows a partly broken-open side view of the device from FIG. 1 in the direction of arrow A.
Figure 3:
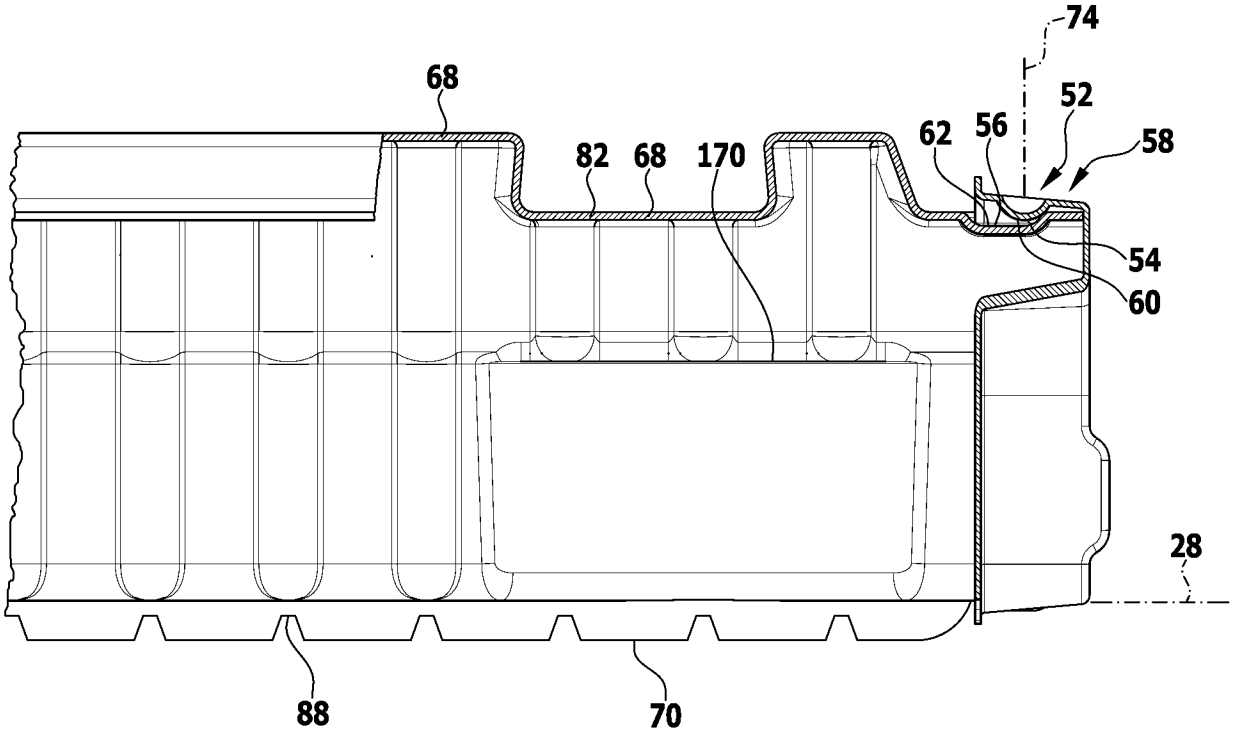
FIG. 3 shows a partial view of a section along line 3-3 in FIG. 1.

A height of the upper-part wall 114 increases continuously along the sides 124 connecting the two upper-part wall sections 116 and 118, more specifically, starting from the upper-part wall section 116 to the upper-part wall section 118, so that, in the closed position, as shown in FIG. 2, an upper-part edge 126 extends at an incline relative to the bottom plane 28.

A coupling device 128, which enables the releasable connection of the upper part 18 and the lower part 16 to each other, serves to securely close the package 14. The coupling device 128 comprises first and second interacting coupling elements 130 and 132, which are formed on the wall 50 and on the upper-part wall 114. In the closed position, the first and second coupling elements 130 and 132 are in engagement with each other with force and/or positive locking.

The coupling device 128 preferably takes the form of a locking connection device 134, with the first and second coupling elements 130, 132 taking the form of locking connection elements which can be brought into engagement with each other.

The first coupling elements 130 take the form of flange-like coupling projections 136 projecting laterally from the lower-part wall 36. Formed so as to correspond to these on the upper part 18 is a circumferential coupling recess 138 in the form of a bead, which is open in the direction facing the interior 22 and, in the closed position, receives the coupling projection 136. In the closed position, the upper part 18 is therefore coupled in a locking manner to the lower part 16.

The upper part 18 further comprises a positioning device 140 for defined positioning of the packaging containers 12. It comprises a plurality of positioning recesses 142, which, in the closed position, are open in the direction facing the bottom 24. The positioning recesses 142 have a rotationally symmetrical basic shape. For stabilizing the positioning recesses 142, these are provided with stiffening elements 144, which take the form of cross-shaped recesses, which rise somewhat above the positioning recesses away from the interior 22 and project somewhat over these laterally, but are also open in the direction facing the interior 22. Sterilization channels 145, which enable, in particular, a sterilization gas such as ethylene oxide to flow into the packaging containers 12, also when the package 14 is closed, i.e., when the upper part 18 is fitted, are formed by the stiffening elements.

Figure 5:
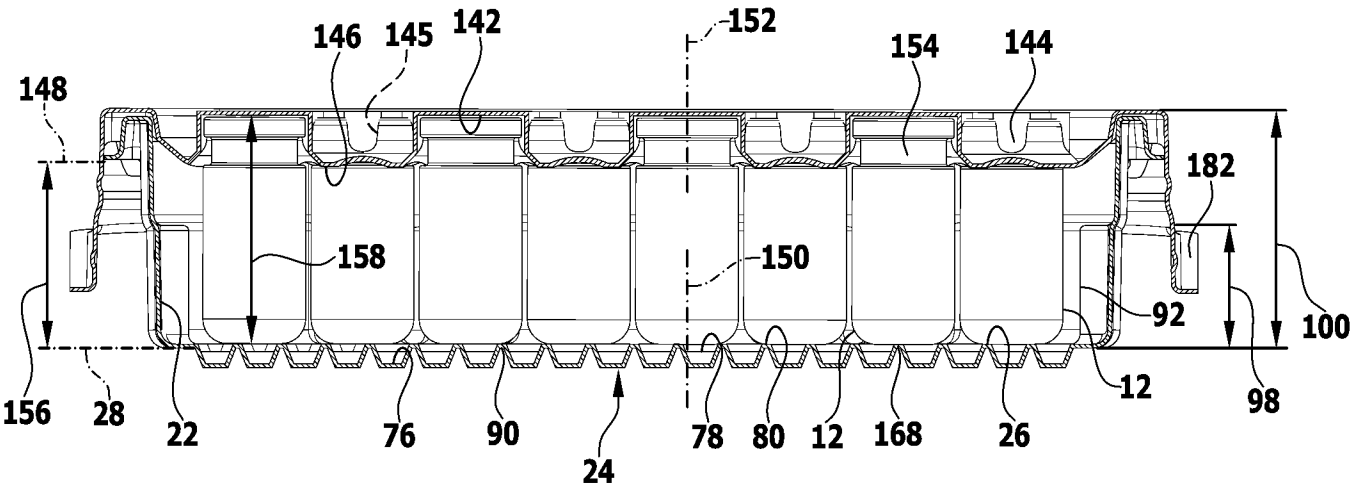
FIG. 5 shows a sectional view along line 5-5 in FIG. 1.
Figure 6:
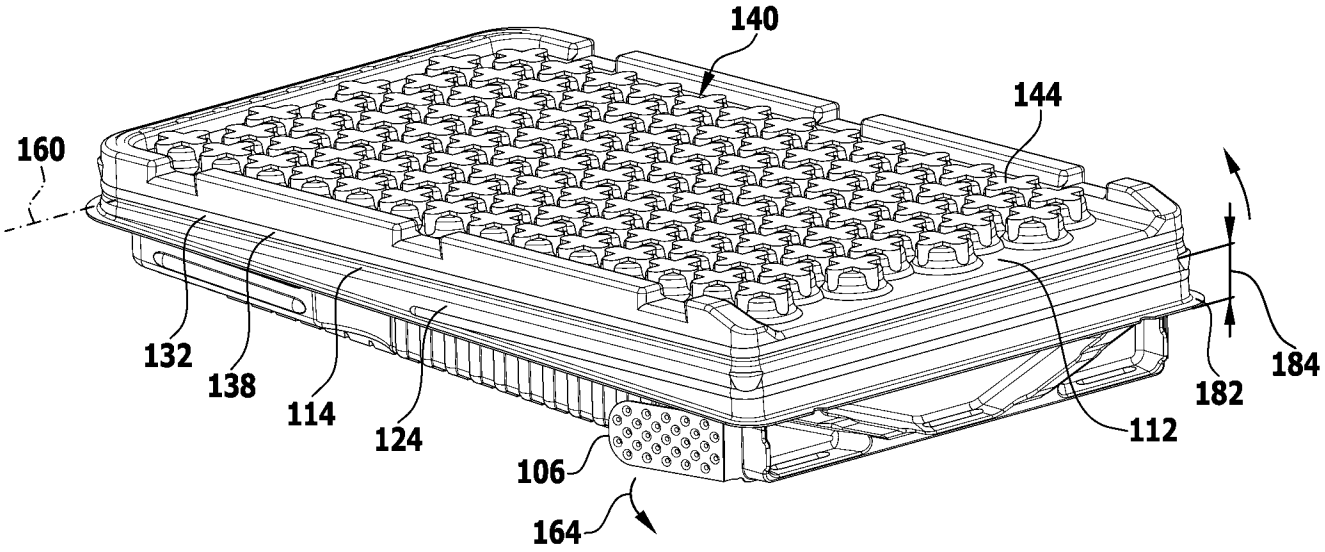
FIG. 6 shows a view similar to FIG. 1 with an upper part raised somewhat in the area of the separable wall element.

The upper part 18 defines with its underside 146 an upper-part plane 148 which, in the closed position, as shown in FIG. 5, extends parallel to the bottom plane 28. Each packaging container 12 defines a packaging-container longitudinal axis 150. Each positioning recess 142 defines a positioning-recess longitudinal axis 152. In the closed position, a positioning-recess longitudinal axis 152 and a packaging-container longitudinal axis 150 coincide or coincide substantially, in each case, as shown schematically in FIG. 5.

The packaging containers 12 preferably have a rotationally symmetrical shape and dimensions which enable part of the packaging container 12, in the closed position, to enter the positioning recess 142. This is shown schematically in FIG. 5 by an upper neck region 154 of the packaging containers 12, which may, for example, take the form of storage glasses, projecting into the positioning recess, so that each storage container 12 is positioned in a defined manner in the interior 22. In particular, the packaging containers 12 are positioned in the interior 22 so as to just not touch one another, thereby avoiding damage to the packaging containers 12, in particular, during transportation of the package 14.

In the closed position, the positioning of the packaging containers 12 is secured, in particular, by a spacing 156 between the upper-part plane 148 and the bottom plane 28 being smaller than the height 158 of the packaging containers 12.

The packaging containers, as already explained, preferably take the form of primary packaging articles, for example, storage glasses, pipettes, ampoules or the like.

The package 14, as shown in the Figures and described hereinabove, is, therefore, in its entirety, only of three-part construction. It comprises the unit 38, the wall element 46 and the upper part 18. The three aforementioned elements are preferably produced from a plastic material, for example, using a thermoforming method.

The unit 38, the wall element 46 and the upper part 18 each comprise stacking lugs 170, 172*a* and 172*b*, and 174, respectively, enabling a defined stacking of the three aforementioned elements, so that after each has been manufactured separately, they can be provided as stack of identical elements and can be easily and safely removed from the respective stack for formation of the package 14.

The stacking lugs 170 are formed by the holding recesses 92, which have a stacking surface 176 facing away from the bottom 24 and serving as stop surface for the bottom 24 of a further unit 38 which is placed parallel to the bottom 24 and with the gap 44 oriented in the same direction on the unit 38. In this way, units can be stacked directly one on top of the other with a spacing corresponding to the height 98.

The stacking lugs 172*a* and 172*b* are formed by recesses 178*a* and 178*b* formed by deep-drawing in the end wall 48 and facing away from the interior 22, which, in a plan view of the wall element 46, are of substantially triangular shape. The recesses formed on an outer side of the wall element 46 create projections facing the interior 22, which define the stacking lugs 172*a* and 172*b* and prescribe a spacing of wall elements 46 stacked one on top of the other.

Finally, the stacking lugs 174 are formed by deep-drawn projections, more specifically, at edges of the upper part 18, at which the sides 124 converge. The projections define stacking surfaces 180 facing away from the bottom 24 and extending parallel to the cover plate 112, which serve as stop surfaces for a circumferential flange 182, projecting laterally from the sides 124 and the upper-part wall sections 116 and 118, of a further upper part 18 which is placed parallel to the cover plate 112 and oriented in the same direction on the upper part 18. In this way, upper parts 18 can be stacked with a spacing 184 directly on top of one another, the spacing 184 being defined between an underside of the flange 182 and the stacking surface 180.

The procedure for removing the packaging containers 12 from the package 14 is as follows.

Starting from the closed position, as shown schematically in FIG. 1, the upper part 18 is first completely removed. The separating elements 104 are then gripped by hand or with a mechanical gripper, more specifically, at that part 162 which, in the closed position, projects under the upper-part edge 126, as shown schematically in FIG. 2.

The separating elements 104 are then pivoted back through 90° in the direction of arrow 164 from the closed position to the basic or separated position, and the wall element 46 is separated by pulling it in a direction away from the gap 44.

Once the wall element 46 is separated, the packaging containers 12 can be pushed out through the gap, for example, with a pusher, which engages between the packaging containers 12 and the wall section 34, in order to push the packaging containers 12 through the gap 44 into the filling installation.

Alternatively, the procedure may also be as follows.

Starting from the closed position, as shown schematically in FIG. 1, the separating elements 104 are gripped either by hand or with a mechanical gripper, more specifically, at that part 162 which, in the closed position, projects under the upper-part edge 126, as shown schematically in FIG. 2.

The separating elements 104 are then pivoted back through 90° in the direction of arrow 164 from the closed position to the basic or separated position. The upper-part edge 126 thereby slides on the upper edges 166 of the separating elements 104. The upper part 18 is thereby pivoted about a pivot axis 160, which is defined in the area of the wall section 34 by the first and second coupling elements 130 and 132 engaging each other. These continue to engage each other when the separating elements, as shown in FIG. 7, are already transferred to the basic or separated position.

Figure 7:
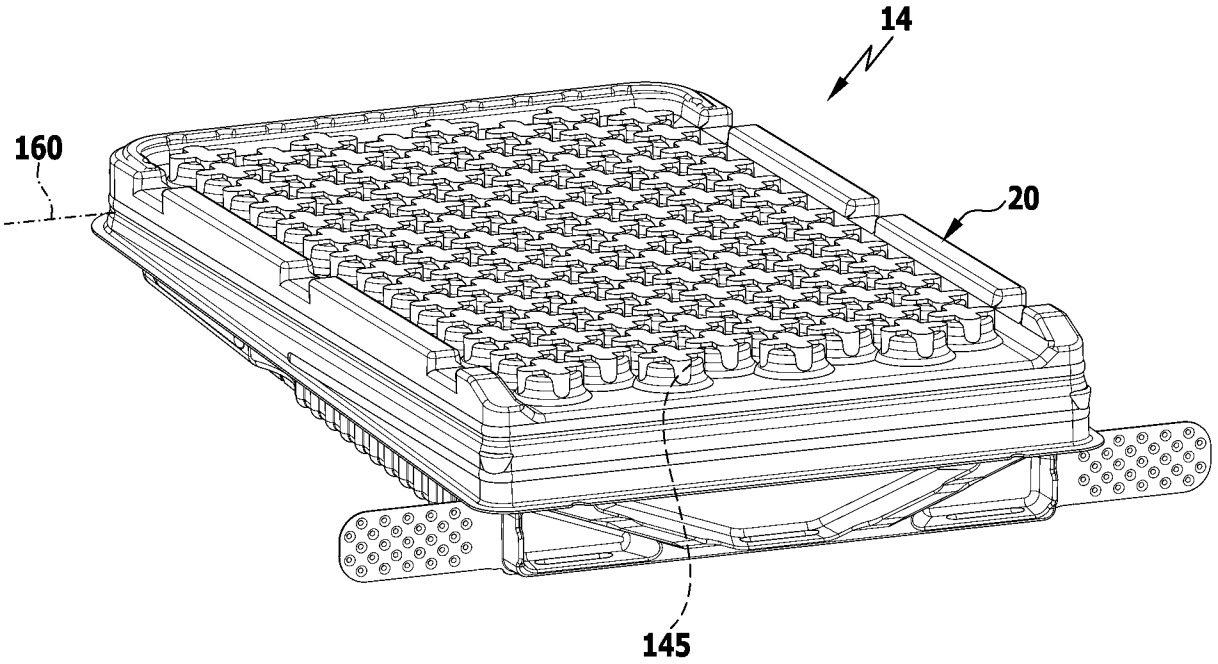
FIG. 7 shows a schematic perspective overall view of the device with the separating device in the separated position and the upper part resting thereon in the area of the separable wall element.

Owing to the upper-part edge 126 extending at a slant in relation to the upper-part plane 148, the upper-part wall 114 continues to engage over the lower-part wall 36 on all sides so long as the upper-part wall 114 rests on the edge 166 of the separating elements 104, as shown schematically in FIG. 7. In this position, the upper-part edge 126 extends substantially parallel to the bottom plane 28. Either the upper part 18 can now be pivoted further upwards and away or the wall element 46 separated by pulling it in a direction away from the gap 44.

Once the wall element 46 is separated, the packaging containers 12 can be pushed out through the gap. In particular, a filling installation can be correspondingly constructed for this purpose and, for example, comprise a holding device with holding elements which engage the holding recesses 92, and a pusher which engages between the packaging containers 12 and the wall section 34, after the upper part 18 has been raised, in order to push the packaging containers 12 through the gap 44 into the filling installation.

With the described package 14, packaging containers 12 can be easily and safely transferred to a filling installation without the packaging containers having to be individually gripped. Their defined positioning in the interior 22 is eliminated after removal of the upper part 18 so that they can be optionally shifted on the bottom surface 26. To prevent tilting of the packaging containers 12 here, the spacings between the webs 80 are so dimensioned that an underside 168 of the packaging container 12 always stands or rests on at least two webs 80.

For sterile transportation, provision may additionally be made for the package 14 to be placed in an outer packaging which, for example, is made from a film which can be closed by welding or adhesion, in order to store the package 14 in a sterile manner and transport it to a secondary producer after it has been manufactured and loaded with the packaging containers 12. It is also conceivable to place the package in an outer packaging comprising two film wraps. It is, of course, also possible for more than two wrappings to be provided.

What is claimed is:

1. Device for at least one of storing and transporting a plurality of packaging containers, comprising:

a tub-shaped lower part, an upper part for closing the lower part in a closed position in which the upper part and the lower part enclose an interior of the device, the lower part comprising a bottom and a lower-part wall projecting from the bottom in a direction of the upper part, a positioning device formed integrally with the upper part for defined positioning of the packaging containers such that the packaging containers are prevented from touching one another so as to avoid damage, the upper part comprising a circumferential upper-part wall which faces the lower part and, in the closed position, engages over the lower-part wall on all sides, the lower part further comprises a wall element which with the lower-part wall forms a circumferential wall of the lower part, the wall element being movable relative to the lower part in order to at least partially open a gap in the lower-part wall, the gap extending to a bottom plane defined by the bottom, and a connection device for releasably connecting the wall element to the bottom and the lower-part wall, the connection device comprising first and second interacting connection elements which are arranged or formed, on the one hand, on at least one of the bottom and the lower-part wall and, on the other hand, on the wall element, wherein:

the first and second connection elements engage one another with at least one of force locking and positive locking in a storage position in which the wall element forms part of the circumferential wall, and the bottom wall comprises a flat interior bottom surface enabling the packaging containers to be one of pushed or slid along the bottom surface and out of the gap.

2. Device in accordance with claim 1, wherein the wall element is separable from the lower part at least one of irreversibly and reversibly.

3. Device in accordance with claim 1, wherein the bottom is of rectangular or substantially rectangular construction, and wherein the lower-part wall comprises at least three complete wall sections which project from side edges of the bottom.

4. Device in accordance with claim 1, wherein the wall element completely closes the gap formed in the lower-part wall.

5. Device in accordance with claim 1, wherein the first and second connection elements are engageable with one another in a direction of connection which is oriented transversely to the bottom surface.

6. Device in accordance with claim 1, wherein the bottom comprises a plurality of depressions which are open in a direction facing the interior.

7. Device in accordance with claim 1, wherein the lower-part wall has an upper lower-part edge which faces in the direction of the upper part and is set back in sections thereof.

8. Device in accordance with claim 3, wherein at least one holding recess is formed, in each case, on two of the three wall sections which are opposite one another on the lower-part wall.

9. Device in accordance with claim 1, further comprising a wall element separating device for automatically separating the wall element from the bottom and the lower-part wall.

10. Device in accordance with claim 9, wherein the wall element separating device comprises at least one separating element which is adapted to be brought from a storage position in which the wall element forms part of the circumferential wall into a separated position.

11. Device in accordance with claim 10, wherein:

the wall element closes the gap formed in the lower-part wall, the at least one separating element, in the closed position, at least one extends parallel or substantially parallel to a wall section of the lower-part wall adjoining the gap and lies against the wall section.

12. Device in accordance with claim 10, wherein the upper-part wall rests in a separated position on the at least one separating element and engages over the lower-part wall on all sides.

13. Device in accordance with claim 1, wherein the positioning device comprises a plurality of positioning recesses which in the closed position are open in a direction facing the bottom, and wherein the positioning recesses comprise sterilization channels.

14. Device in accordance with claim 1, further comprising a plurality of the packaging containers.

15. Device in accordance with claim 14, wherein a spacing between an upper-part plane defined by an underside of the upper part and the bottom surface in the closed position is smaller than a height of the packaging containers, and wherein each of the packaging containers projects at least partially into a positioning recess.

16. Device in accordance with claim 1, wherein the device is at least one of in its entirety of three-part construction and made of a plastic material.

17. Device for at least one of storing and transporting a plurality of packaging containers, comprising:

a tub-shaped lower part, an upper part for closing the lower part in a closed position in which the upper part and the lower part enclose an interior of the device, the lower part comprising a bottom and a lower-part wall projecting from the bottom in a direction of the upper part, the upper part comprising a positioning device for defined positioning of the packaging containers such that the packaging containers are prevented from touching one another so as to avoid damage, the lower part further comprising a wall element which with the lower-part wall forms a circumferential wall of the lower part, the wall element being reversibly separable from the lower part and movable relative to the lower part in order to at least partially open the lower-part wall, and a wall element separating device for automatically separating the wall element from the bottom and the lower-part wall, wherein:

the wall element separating device comprises at least one separating element which is adapted to be brought from a storage position in which the wall element forms part of the circumferential wall into a separated position into which the at least one separating element is pivoted with respect to the storage position about a pivot axis, an upper-part wall of the upper part rests on an upper edge of the at least one separating element and slides thereon for raising the upper part in an area of the wall element during a transition of the at least one separating element from the storage position to the separated position, and the at least one separating element comprises at least one of an extension of the wall element extending perpendicular to the wall element alongside a sidewall of the lower part wall while in the storage position and an extension of the wall element extending outside of the periphery of the upper part while in the separated position.

18. Device in accordance with claim 17, further comprising a connection device for releasably connecting the wall element to the bottom and the lower-part wall.

19. Device in accordance with claim 18, wherein:

the connection device comprises first and second interacting connection elements which are arranged or formed, on the one hand, on at least one of the bottom and the lower-part wall and, on the other hand, on the wall element, and the first and second connection elements engage one another with at least one of force locking and positive locking in a storage position in which the wall element forms part of the circumferential wall.

20. Device in accordance with claim 17, wherein the upper-part wall faces the lower part and, in the closed position, engages over the lower-part wall on all sides.

* * * * *